United States Patent [19]

Dick et al.

[11] Patent Number: 4,667,452

[45] Date of Patent: May 26, 1987

[54] REINFORCING UNIT INCLUDING STEEL MATS CONNECTED BY CONNECTOR BARS

[75] Inventors: Michael Dick, Schrobenhausen; Wilhelm Zechmair, Langenmosen; Peter Bayer, Rettenbach, all of Fed. Rep. of Germany

[73] Assignee: Ytong AG, Fed. Rep. of Germany

[21] Appl. No.: 902,019

[22] Filed: Aug. 29, 1986

Related U.S. Application Data

[63] Continuation of Ser. No. 563,757, Dec. 21, 1983, abandoned.

[30] Foreign Application Priority Data

Apr. 15, 1983 [DE] Fed. Rep. of Germany ..... 3313793

[51] Int. Cl.[4] ..... E04H 12/00

[52] U.S. Cl. ..... 52/650; 52/652; 52/665; 52/712

[58] Field of Search ..... 52/664, 665, 712, 650, 52/652

[56] References Cited

U.S. PATENT DOCUMENTS

| | | | |
|---|---|---|---|
| 3,440,729 | 4/1969 | Schmidgall | 52/652 X |
| 4,226,061 | 10/1980 | Day, Jr. | 52/125.2 |

FOREIGN PATENT DOCUMENTS

| | | | |
|---|---|---|---|
| 279863 | 7/1969 | Austria | 52/712 |
| 7819077 | 1/1979 | Fed. Rep. of Germany . | |
| 29960 | 10/1958 | Finland | 52/687 |
| 6710134 | 1/1969 | Netherlands | 52/600 |
| 1140453 | 1/1969 | United Kingdom | 52/650 |
| 717253 | 2/1980 | U.S.S.R. | 52/712 |

*Primary Examiner*—Carl D. Friedman
*Assistant Examiner*—Naoko N. Slack
*Attorney, Agent, or Firm*—Larson and Taylor

[57] ABSTRACT

A reinforcing unit for aerated concrete components. At least two spaced apart welded reinforcing mats are made up of longitudinally extending main bars and transversely extending crossbars, the crossbars being welded at their intersections with the main bars. The two mats are spaced apart from each other by connector bars which are bent into a C-shape from weldable steel bars, each connector bar having a pair of opposed legs and a spacer portion connecting those legs. The connector bars have openings to allow the passage of lifting rods. A device for forming the connector bars includes a straightening device, a device for adding small flags with holes therethrough, a bending device and a cutting device for cutting the bent connector bars and then a welding device for welding the connector bars to the mats.

14 Claims, 6 Drawing Figures

REINFORCING UNIT INCLUDING STEEL MATS CONNECTED BY CONNECTOR BARS

This application is a continuation of application Ser. No. 563,757 filed Dec. 21, 1983 now abandoned.

The present invention relates to a reinforcing unit for aerated concrete components of the type which are autoclaved, and which unit comprises at least two spaced apart reinforcing mats and transversely extending crossbars, the latter being welded at their crosspoints with the main, longitudinally extending bars, and the mats being spaced apart by connector bars which are welded to the bars of the mats, and the connectors bars being provided with openings for the passage of lift rods.

West German Utility Model No. 78 19 077 describes a type of reinforcing unit having mats which are spaced apart with plate strips which are welded to the crossbars. These plate strips, which are substantially U-shaped in side elevation have in the free terminal area of their U-legs stops or connecting openings with which they are positioned on a crossbar and a main bar so that the base of the U-shape faces towards the interior of the space between the reinforcing mats with the legs welded to the crossbars. The shaping of the plate strips requires a considerable amount of work so that they are relatively expensive. Considerable work input is also required to position the various elements for welding, especially if the welding is done automatically. Therefore, at least for reasons of high cost, this arrangement which uses plate strips has not gained wide acceptance. In addition, where the reinforcing mats have different dimensions, it is necessary to stock different types of plate strips or other means for connecting the reinforcing mats which correspond to these different dimensions, resulting in expensive storage costs. The plate strip is an element which differs in kind from the remaining elements of the reinforcing unit and hence the manipulation of the plate strip requires technical knowledge which differs substantially from that needed for the fabrication of the elements of the reinforcing mats themselves which comprise for the most part steel bars and the like.

On the other hand, fabrication of a reinforcement of the above mentioned type has been known for many years wherein the mats are shaped out of bent, weldable steel bars and hence not requiring other manufacturing techniques such as the technique associated with plate strips. In these previous arrangements spacers for spacing apart the mats, when viewed in side elevation, comprise two trapezoidal spacing elements wherein the free legs of one spacing element are welded to the outer main longitudinal bar of one mat while oppositely thereto the free leg of the other spacer element is welded from the outside onto the outer main longitudinal bar of the other mat such that the base of the trapezoid formed by each spacer element faces towards the opposite mat, and wherein the bases of the trapezoids overlap. The legs of the spacer element are welded to their respective contact points and the overlapping areas then form the connecting openings for a lift rod. To ensure this manner of connecting the mats to the reinforcing unit, the free legs of the spacer element must engage the main bars from the outside. This means that the spacer elements cannot be arranged within the intermediate space between the opposing mats of the reinforcement unit even though this would be desirable in many cases in order to place the reinforcement unit close to the surface of the concrete component in which it is cast.

Another disadvantage of these prior spacer elements is that they also must be prefabricated and the connection of the two spacer elements must be established with a high degree of precision since they provide the insertion openings for the lift rods which must be positioned quite accurately in the reinforcement unit. For very large reinforcement units, correspondingly large spacer elements must be maintained in storage.

Another disadvantage of this prior arrangement is that the welding points with which the spacer elements are attached to the main bars are subjected to a shearing stress during the handling of the reinforcement unit. In practice this can lead to weld fractures, rendering the reinforcement unit useless.

It is therefore an object of the present invention to provide a reinforcement unit which can withstand handling as well as a method for automating the fabrication of the reinforcement units without requiring a changeover when the job requires reinforcement units of different sizes.

These objects are achieved in accordance with the present invention in the following manner.

As a result of the novel, special shape of the spacer elements, which are refered to below as connector bars, the latter can be placed at any point within the reinforcement unit. This in turn has the surprising advantage that the spacing between opposed connector bars can, to a limited extent, be the same in a large reinforcement unit as well as in a relatively smaller reinforcement unit, that is, in a large reinforcement unit the connector bars are positioned deeper into the intermediate space between the reinforcing mats than in the case of a smaller reinforcement unit. Because of the identical spacing between the connecter bars in the larger reinforcement units, only one type of lift rod need be used. It is sufficient to direct this lift rod to specific spacings between the connector bars. Heretofore, for relatively large reinforcement units, one had to use relatively long lift rods. However, lift rods are relatively expensive and the present invention permits reduction in cost by reducing the number of rods required. It is no longer necessary to change over to a different lifting rod and this eliminates the cost resulting from long delays during the change over of lifting rods.

Another advantage of the present invention is that the relatively uncomplicated simple shape of the novel connecting bars permits standardization of spacing in relatively large reinforcement units. Because of this advantage, with relatively simple means one can substantially improve the production technique of such reinforcement units.

The present invention will now be described in considerable detail below with respect to preferred embodiments as illustrated in the drawings wherein.

Refering now to the figures, like numerals represent like elements throughout the several views.

Figure 1:
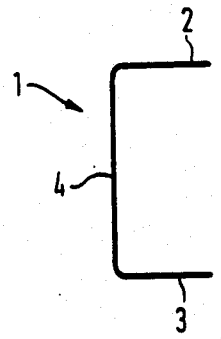
FIG. 1 is a side view of a new connector bar according to the present invention.

Referring to the figures, C-shaped connector bars 1 are bent into shape from a reinforcing steel bar. These connector bars have a first leg 2, a second leg 3 and a spacer portion 4. The thickness of the bar material of connector bar 1 approximately corresponds to the main bars 5 (see FIG. 3) and/or the crossbar 6 of the reinforcing mats 7 and 8. According to a modification of the present invention which is shown in FIG. 2, the connector 1*a* comprises a pair of facing C-shaped connector bars which are made in one piece by means of a connector piece 3*a*.

In the following description, for purposes of illustration, the elements will be described with their orientation as shown in FIGS. 1 though 3 with the mat 7 uppermost and the first leg 2 also uppermost, being the upper leg, and the second leg 3 being the lower leg in the vicinity of the lower mat 8. However, it will be understood that in practice the reinforcement unit can have any orientation.

Figure 2:
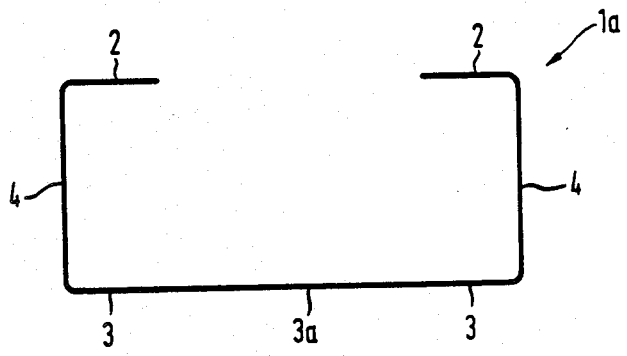
FIG. 2 is a side view of a modified connector bar according to the present invention.
Figure 3:
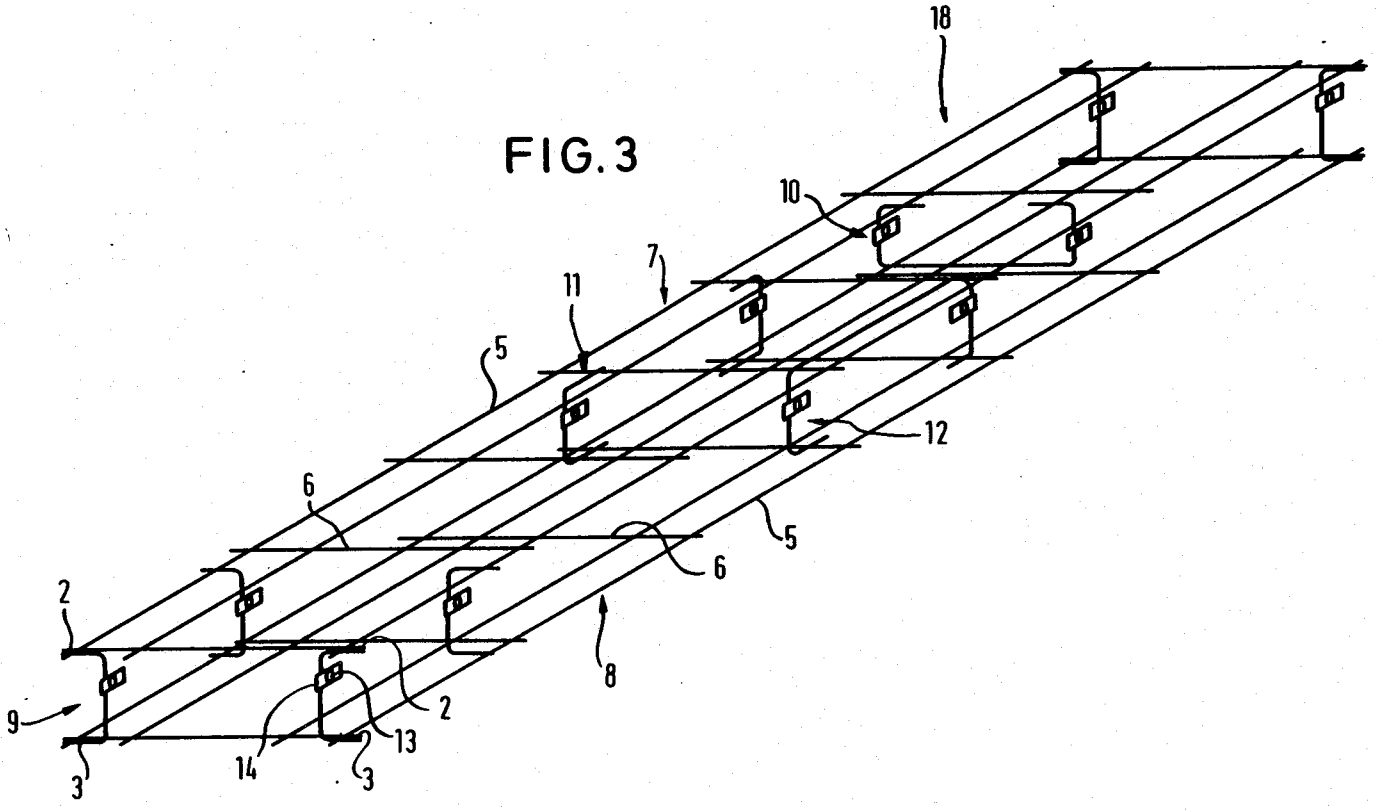
FIG. 3 is a schematic perspective view of a reinforcement unit made in accordance with the present invention.

Referring to FIG. 3, the welded steel reinforcing mats 7 and 8 are spaced apart by the connector bars of the type shown in FIGS. 1 and 2 which preferably comprises main longitudinally extending bars 5 arranged parallel to each other in a single plane and a plurality of crossbars 6, also parallel to each other and extending perpendicularly to the main bars 5. The main bars and crossbars are welded together at their intersections, i.e. crosspoints, to form the mats themselves. The crossbars can be arranged on the interior side or the exterior side of the reinforcement unit.

The connector bars 1, 1*a* are placed in the intermediate space between the mats 7 and 8 with the horizontally extending legs 2 and 3 each being welded with a main bar 5 of the upper mat 7 and a main bar 5 of the lower mat 8, preferably by spot welding. The legs 2 and 3 are parallel to the crossbars 6 so that these legs cross the main bars to which they are attached at right angles. See for example FIG. 3 at locations 9 and 10. For example, provision can be made whereby the legs 2 and 3 rest on the outer side of the main bar 5 or these legs can rest with one leg on the outer side of the main bar and the other placed against the interior side of its corresponding main bar. Advantageously, both legs 2 and 3 are put into place from the interior space between the main bars. This facilitates the positioning of a connector bar prior to welding, and this is particularly so if the crossbars are placed on the outer side, i.e. if they are welded onto the main bars from the outside. The C-shape of the connector bars may for example face outwardly, i.e. the spacer portion 4 may lie deeper into the interior space of the reinforcement than the legs 2 and 3. See for example location 9 in FIG. 3. However, one may also reverse this positioning. The choice of the positioning possibility depends on the desired spacing between the opposed connector bars. If the crossbars 6 are arranged so as to rest on the interior side of the main bars, legs 2 and 3 are in contact with the crossbars and it is advisable to attach the connector bars also to their respective crossbar 6 by welding. This will considerably increase the stability of the reinforcement unit.

The present invention creates the possibility of providing connector bars as shown in FIG. 1 at any location along the longitudinal direction of the reinforcement unit. Similarly, no limits are placed on the transverse positioning of the connector bars since it is possible to choose the length of the legs 2 and 3 and/or it is possible to connect the legs 2 and 3 to a different main bar which lies closer to the center line of the reinforcement unit, and moreover any desired positioning of the spacer portion 4 in the transverse direction can be provided.

Like the connector bar 1, the connector bar 1*a* can also be positioned at different locations. However, the connector bars 1 and 1*a* can also be welded at the crosspoints of their legs 2, 3 parallel to the main bars 5 or parallel to the crossbars 6. See positions 11 and 12 in FIG. 3.

It is necessary that at least two connector bars 1 always be arranged opposite to each other in the transverse direction of the reinforcement unit 18, as well be apparent from FIG. 3. Such an arrangement will always be the case when utilizing the binders of FIG. 2 when they are arranged transversely as shown at position 10 in FIG. 3.

Figure 5:
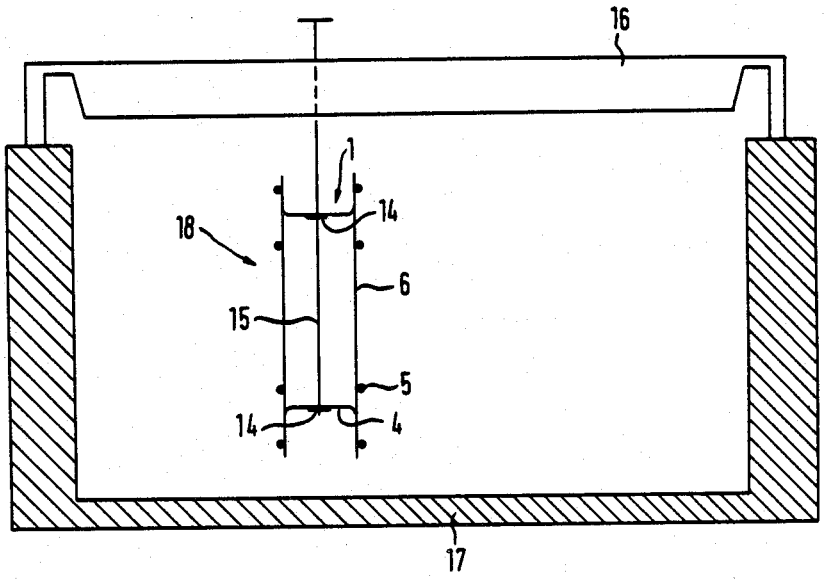
FIG. 5 is an end view of a reinforcement unit on a lift rod mounted in a casting mold.

A small flag 14 having a hole 13 passing therethrough is provided on each spacer portion 4. These provide an opening for the passage of a lift rod 15 as shown in FIG. 5.

This lift rod 15 is inserted in a manner known per se from the narrow side of the reinforcement unit 18 through to the opening 13 of the flag 14 on the connector bar transversely aligned with the first said connector bar. This will be apparent from FIG. 5. The positioning of the flags 14 in alignment with each other in the transverse direction will permit this required insertion possibility. The lift rod 15 is mounted on a supporing beam 16 which bridges a casting mold 17. The uncured aerated concrete mixture is then placed into the casting molds until the reinforcement unit 18 is totally immersed in the casting material.

Figure 4:
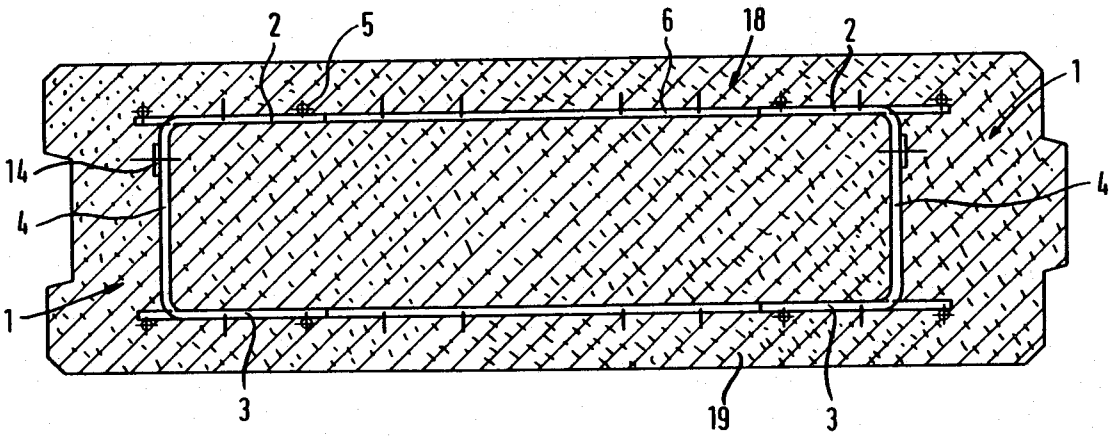
FIG. 4 is a schematic, cross-sectional view of a reinforced wall board made from aerated concrete including a reinforcement unit of the present invention.

FIG. 4 illustrates by way of example one possible position or arrangement of a reinforcement unit 18 in a component 19 made for example from aerated concrete, whereby the legs 2 and 3 of the C-shaped connector bars 1 are arranged to face inwardly.

An advantange of the new shape of the connector bars 1 and 1*a* is the possibility that automated fabrication of the reinforcement units 18 can be considerably simplified since through simple bending operations the connector bars 1 and 1*a* can be bent from a straight reinforcing steel bar which is drawn from a roll and cut off. Advantageously, a bending device suitable for this purpose is placed upstream of an automatically operating welding device and the connector bars are welded in the welding device between two prefabricated reinforcing mats held parallel to each other. Since the bending device can feed the welding machine directly with connector bars 1 or 1*a*, it is no longer necessary for connector bars to be prefabricated and maintained in storage.

The bending device can also be adjusted to produce connector bars of different sizes. With this feature, by merely changing the adjustment on the means which form the connector bars from the straight incoming stock, reinforcement units of different thicknesses, i.e. with different distances between the opposed reinforcing mats, can be produced with the same welding device. This is possible because of the welding device, in a manner known per se, would be capable of automatically placing the opposed reinforcing mats which are to be connected together at varying distances from one another. The conveying and positioning devices for the connector bars operate independently of the size of the connector bars so that likewise no down time and changeover time is necessary for changing the size of the connector bars. Thus, in this respect the present invention provides a substantial saving and hence a major contribution to the art.

Figure 6:
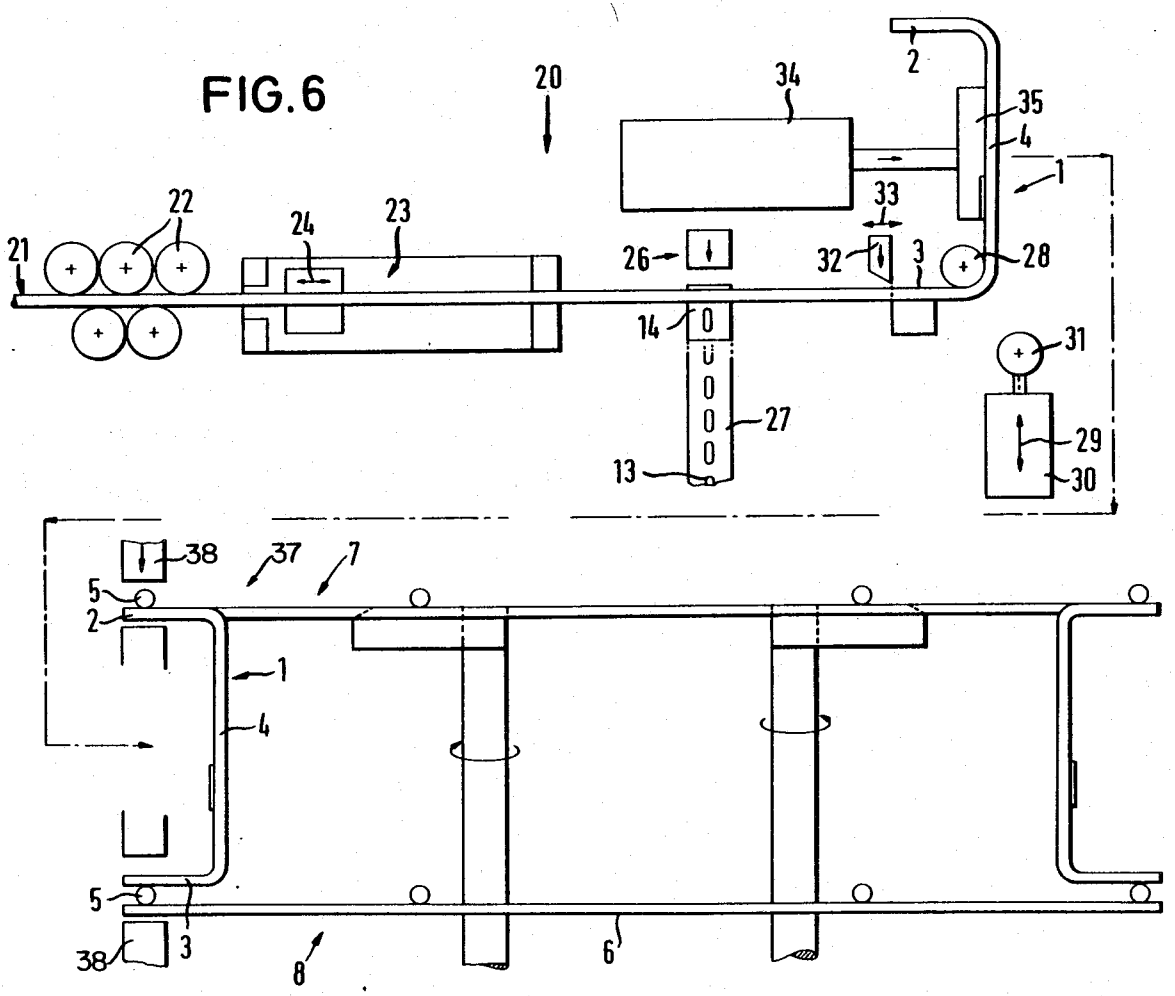
FIG. 6 is a schematic view of a system for fabricating a reinforcement unit embodying the present invention.

Referring to FIG. 6, the welding device 37 for fabricating a reinforcement unit 18 provides an upstream wire bending device 20 which periodically draws from a roll (not shown) a reinforcing steel bar 21 (which because it is drawn from a roll may also be refered to as a reinforcing wire) by means of a traction device 23 which moves in the direction of the double arrow 24. The steel bar or wire 21 is straightened in a manner known per se by means of straightening rolls 22 located upstream from the traction device 23. The length of the path of the traction device 23 is variable. This traction device 23 pushes the bar 21 periodically through a welding machine 26 in which a small flag 14 is cutoff from a perforated sheet metal strip 27 and welded to the bar 21. The bar 21 then passes to a bending roll 28 where the bar 21 is bent 90° by means of the counter roll 31 which is attached to a power unit 30 which moves the counter roll 31 in the direction of the double arrow 29. This bending device 28, 30, 31 can be programmed such that the C-or double C-shaped connector bars 1 or 1*a* can be made with differing deminsions of the legs 2 and 3 or of the spacer portion 4 as well as the connecting bar 3*a*. With a separating means 32 provided upstream of the roller 28 and movable in the direction of the double arrow 33, the bar 21 is cut following bending into the form of a connector bar 1, 1*a*.

A conveyor 34 includes a magnet 35 which holds the newly formed connector bar. By means of conveyor 34 the connector bar can be conveyed to the welding machine 37 and positioned at that location between the mats 7 and 8, whereupon, by means of electrodes 38 located outwardly from the reinforcing mats, the legs 2 and 3 are welded to their respective main bars 5.

Although the invention has been described in considerable detail, it will apparent that the invention is capable of numerous modifications and variations, apparent to those skilled in the art, without departing from the spirit and scope of the invention.

We claim:

1. A reinforcing unit for aerated concrete components comprising:

at least two spaced-apart welded steel reinforcing mats, each reinforcing mat comprising (a) longitudinally extending main bars and (b) transversely extending crossbars which are welded at the crosspoints with the main bars;

the mats being spaced apart a predetermined distance by a plurality of connector bars located completely between the reinforcing mats and welded to the bars of the mats, each of said connector bars being shaped from a bendable weldable steel bar, characterized by each said connector bar being bent out of a reinforcing steel bar into a C-shape, having a straight first leg, an opposed straight second leg parallel to the first leg, and a straight spacer portion connecting the first and second legs and generally perpendicular to both legs, each of the first and second legs being parallel to and welded to an adjacent one of a said main bar and a said crossbar of each reinforcing mat adjacent a crosspoint, and each of said first and second legs also being welded at a crosspoint to the other of said main bar and said crossbar of each reinforcing mat.

2. A reinforcing unit according to claim 1, characterized in that at least one connector bar comprises two C-shaped connector bars with the C-shapes facing each other, which are made of one piece via a connecting piece connecting the opposed facing legs of the two connector bars.

3. A reinforcing unit according to claim 1, characterized in that the thickness of the bar material of the connector bars corresponds to the thickness of the main bars and/or the said crossbars.

4. A reinforcing unit according to claim 1, characterized in that the first and second legs are each welded to a main bar of each of the two reinforcing mats by spot welding.

5. A reinforcing unit according to claim 4, characterized in that the said legs are parallel to the crossbars.

6. A reinforcing unit according to claim 1, characterized in that both legs of at least some connector bars are located totally inside the space between the main bars of the two opposing mats.

7. A reinforcing unit according to claim 1, including a pair of connector bars aligned transversely and located near opposite sides of the unit, characterized in that the opening of the C-shapes of the two connector bars face outwardly away from each other.

8. A reinforcing unit according to claim 1, including a pair of connector bars aligned transversely and located near opposite sides of the unit, characterized in that the opening of the C-shapes of the two connector bars face inwardly towards each other.

9. A reinforcing unit according to claim 1, characterized in that the legs of at least some connector bars are welded to a crossbar.

10. A reinforcing unit according to claim 1, characterized in that at least some of the connector bars are arranged with their legs parallel to the main bars and are welded at their crosspoints with the crossbars.

11. A reinforcing unit according to claim 1, characterized in that at least two connector bars are arranged opposite to each other in the transverse direction of the reinforcing unit.

12. A reinforcing unit according to claim 1, characterized in that the engaging means is a small flag having a hole therethrough which is attached to the spacer portion of at least some of the connector bars.

13. A reinforcing unit according to claim 1, characterized in that each of said spacer portions includes a means for engaging a lift bar.

14. A reinforcing unit according to claim 13, characterized that said engaging means is a small flag having a hole therethrough which is attached to the spacer portion.

* * * * *